US005915820A

United States Patent [19]

Kraeuter et al.

[11] Patent Number: 5,915,820

[45] Date of Patent: Jun. 29, 1999

[54] SHOE HAVING AN INTERNAL CHASSIS

[75] Inventors: Charles D. Kraeuter; Xavier K. Kalin, both of Lake Oswego, Oreg.

[73] Assignee: Adidas A G, Germany

[21] Appl. No.: 08/697,184

[22] Filed: Aug. 20, 1996

[51] Int. Cl.[6] ..... A43B 13/38; A43B 7/14

[52] U.S. Cl. ..... 36/114; 36/154; 36/44; 36/102; 36/88

[58] Field of Search ..... 36/31, 44, 43, 36/154, 155, 102, 145, 152, 166, 171

[56] References Cited

U.S. PATENT DOCUMENTS

| | | | |
|---|---|---|---|
| 730,366 | 6/1903 | Gunthorpe . | |
| 2,680,919 | 6/1954 | Riggs | 36/71 |
| 3,550,597 | 12/1970 | Coplans | 128/585 |
| 4,398,357 | 8/1983 | Batra | 36/30 |
| 4,439,934 | 4/1984 | Brown | 36/44 |
| 4,562,651 | 1/1986 | Frederick et al. | 36/102 |
| 4,715,131 | 12/1987 | Kremendahl | 36/44 |
| 4,783,910 | 11/1988 | Boys, II | 36/107 |
| 4,803,747 | 2/1989 | Brown | 12/142 |
| 5,384,973 | 1/1995 | Lyden | 36/102 |
| 5,408,761 | 4/1995 | Gazzano | 38/88 |

FOREIGN PATENT DOCUMENTS

| | | | |
|---|---|---|---|
| 91/12740 | 9/1991 | WIPO | 36/44 |
| 94/13164 | 6/1994 | WIPO | 36/31 |

*Primary Examiner*—Paul T. Sewell
*Assistant Examiner*—Anthony Stashick
*Attorney, Agent, or Firm*—Marger Johnson & McCollom, P.C.

[57] ABSTRACT

A structural chassis includes a structural chassis and a foam chassis or sock liner sandwiched together to form an assembly that can be inserted into and substantially occupy a footbed of a shoe upper. Discrete sole elements are attached to a bottom side of the upper so as to expose certain portions of the bottom side therebetween. This absence of outsole material in those areas makes the upper collapsible about those areas since the outsole provides no support in those areas. Instead, the structure is provided by the chassis of the chassis, which is customized to the user's foot by placing one or more notches in strategic locations along the chassis where the foot naturally flexes. One such notch is located on the chassis in a position that allows the chassis to flex about a forward push-off axis of the foot that runs through the first and second MTP joints. Two collinear notches are formed on the chassis to allow the structural chassis shoe to flex about a lateral push-off axis that runs through the third, fourth and fifth MTP joints.

35 Claims, 11 Drawing Sheets

SHOE HAVING AN INTERNAL CHASSIS

BACKGROUND OF THE INVENTION

This invention relates generally to shoes, and more particularly to shoes wherein light weight and the ability to tailor the stiffness and flexure of the shoe is an important consideration.

Shoes encounter tremendous forces during running or sports. Over the years, efforts have been made to reduce the resultant stresses on the feet and legs. One advance in this area has been the incorporation of cushioning material in the shoe sole to absorb the impact and cushion the foot as the shoe strikes the ground. This cushioning material is typically formed into a layer called the "midsole" which is interposed between the ground-engaging "outsole" and the shoe upper. The cushioning midsole, which should also flex with the foot, is typically made of ethyl-vinyl-acetate (EVA) or polyurethane (PU), although other resilient, cushioning materials could be used.

While the cushioning provided by a midsole is an advantage, its added weight hinders the performance of athletic shoes (particularly running shoes), which must be as light as possible. The problem of added weight from the midsole is recognized in U.S. Pat. No. 5,319,866 issued to Foley et al. Foley et al. attempts to solve the problem by substituting an arch support in place of the midsole and outsole underlying the arch area of the foot.

The use of a midsole between the outsole and the upper also positions the foot higher above the ground, creating a less stable platform for the foot. This problem is addressed to some degree in U.S. Pat. No. 4,542,598 issued to Misevich et al. The Misevich shoe includes a heel plate between two heel midsole layers to support and cushion the heel, and a forefoot board inside the upper over a forefoot midsole layer to support and cushion the forefoot. As in Foley, Misevich eliminates the midsole beneath the arch, thereby saving some weight. Unlike Foley, however, Misevich does not provide any additional structure to support the arch.

The negative effects of the impact to the feet and legs can be amplified if the shoes are not properly shaped and tuned to the particular sport, and to the individual's foot. Mass-produced athletic shoes come in standard sizes and shapes, and usually include an arch support designed to fit a "standard" foot. Prior art shoes, such as those typified by Foley and Misevich, include no provision for tailoring the shoe to fit an individual foot, except for the use of orthotics. Orthotics are well-known in the art, and are exemplified by U.S. Pat. No. 4,803,747 issued to Brown. Orthotics, however useful, represent additional, undesirable weight, and also stiffen the shoe and otherwise compromise its performance.

A further disadvantage of the prior art shoes is that they cannot be readily "tuned" to meet the particular needs of the wearer. This is particularly important for athletes who demand maximum performance out of their shoes. What "tunability" is provided by the prior art requires a complex trade off between all of the elements of the shoe including the outsole, the midsole, and structural members that make-up the shoe, and must normally be done at the design stage, and cannot be varied by the customer.

Accordingly, a need remains for a light-weight shoe that minimizes the material in the sole, adequately supports the foot, and which can be readily customized for an individual's foot or for a particular activity.

SUMMARY OF THE INVENTION

It is, therefore, an object of the invention to provide a shoe, in particular an athletic shoe, which can be customized to support the foot according to an individual's specific characteristics and the requirements of a particular sport or activity.

It is another object of the invention to eliminate the need for an outsole and midsole which span substantially the entire length of the shoe.

It is still another object of the invention to provide a shoe having a removeable support member within the upper, and which can be selected to provide optimum support for the wearer's foot, and which can also be selected to optimize the support and flexure characteristics of the shoe for a particular activity.

It is yet another object of the invention to provide a shoe having a lacing system which does not irritate the tendons and connective tissue in the foot.

A shoe according to the invention includes an upper, a removeable chassis, or support member, within the upper to support the foot, and one or more ground-engaging sole elements affixed to the bottom of the upper at discrete locations, and which leave portions of the upper unsupported by the sole elements. The weight of the shoe is thereby minimized because the full-length midsole and outsole have been replaced by the discrete sole elements. The structural chassis may be contoured to closely fit the underside of the foot, and may include an overlayed foam insole or sock liner, which may also be contoured to fit the underside of the foot. In one embodiment, the structural chassis has one or more notches or slots in locations selected to permit a desired flexure of the foot. The length and width of the notches can be varied to vary the shoe's flexibility. Alternatively, the structural chassis can be without flexure notches, and rely instead on differing thicknesses of materials to vary its flexibility in different areas of the shoe.

Because the structural chassis can be readily removed and another installed in its place, the shoe can be custom fitted to an individual's foot, or optimized for a specific activity by substituting a different structural chassis.

In another aspect of the invention, a lace guide wraps under the shoe and upwardly around the sides about midway along the upper. The lace guide provides a plurality of beads through which a lace can be wrapped to secure the shoe to the user's foot. The lace guide is made of a flexible, translucent plastic in the preferred embodiment, and is sewn into the upper with the beads exposed. The lace guide also cooperates with the structural chassis by providing a recess that receives a corresponding protrusion in the structural chassis when it is inserted into the upper. The lace guide thereby aligns the structural chassis in the upper, and helps maintains it in position while in use.

A shoe according to the present invention utilizes a single structure for altering the support and flex of the shoe, thereby overcoming the disadvantage in the prior art that requires multiple elements to be modified to achieve the same result.

The foregoing and other objects, features and advantages of the invention will become more readily apparent from the following detailed description of a preferred embodiment of the invention which proceeds with reference to the accompanying drawings.

DETAILED DESCRIPTION

Figure 1:
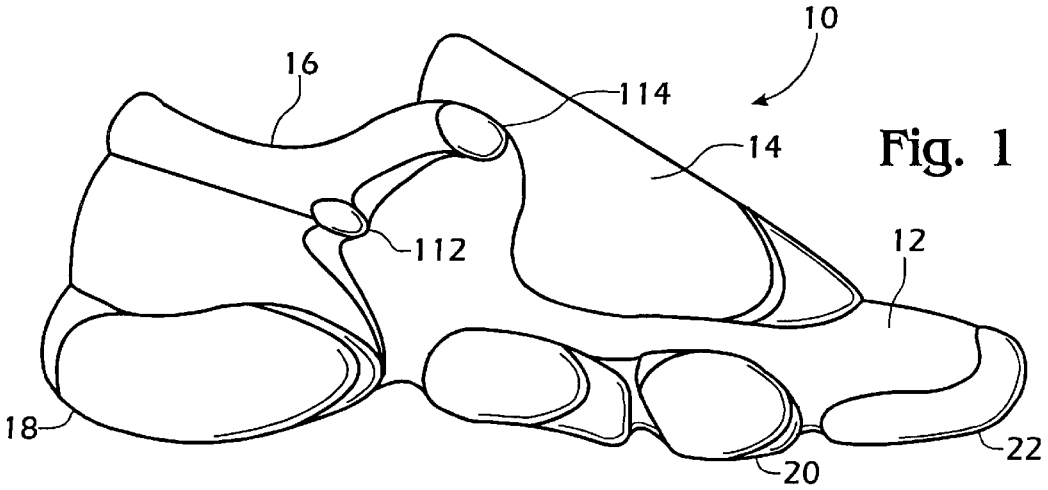
FIG. 1 is a right side elevational view of a shoe according to the invention.
Figure 2:
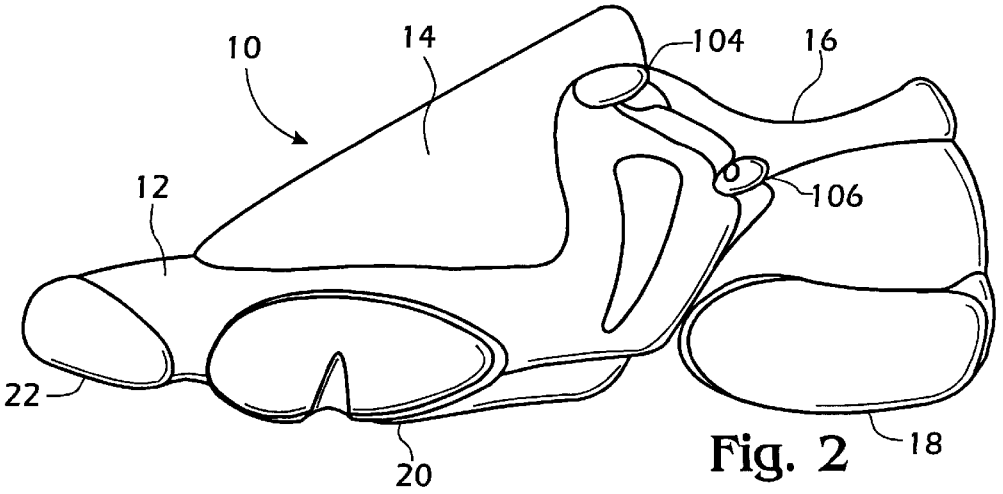
FIG. 2 is a left side elevational view of the shoe shown in FIG. 1.
Figure 3:
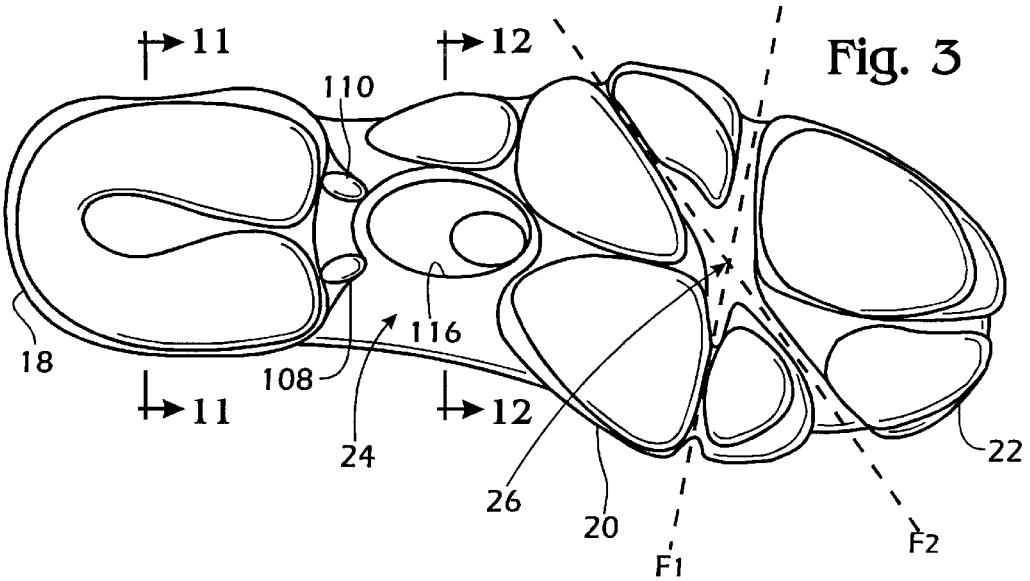
FIG. 3 is a bottom plan view of the shoe shown in FIG. 1.

A right shoe 10 according to the invention is shown in FIGS. 1–3. A corresponding left shoe is a mirror image of the right shoe and is therefore not described further. The shoe includes an upper 12 that is designed to receive a foot. The upper 12 can be made of any number of materials as is known in the art including mesh and/or leather. Affixed to the upper 12 is an exposed mesh tongue 14. In the embodiment shown in FIGS. 1 and 3, the shoe uses a lace guide which will be described in greater detail below. In alternate embodiments (not shown) a conventional lacing system incorporating holes in the upper is used. The upper further includes a foam-filled ankle collar 16 surrounding the ankle opening of the shoe for added comfort. The description of the upper 12 is by way of illustration, and not for purposes of limitation, since numerous alternative uppers will work in combination with the structural chassis described further below.

Figure 4:
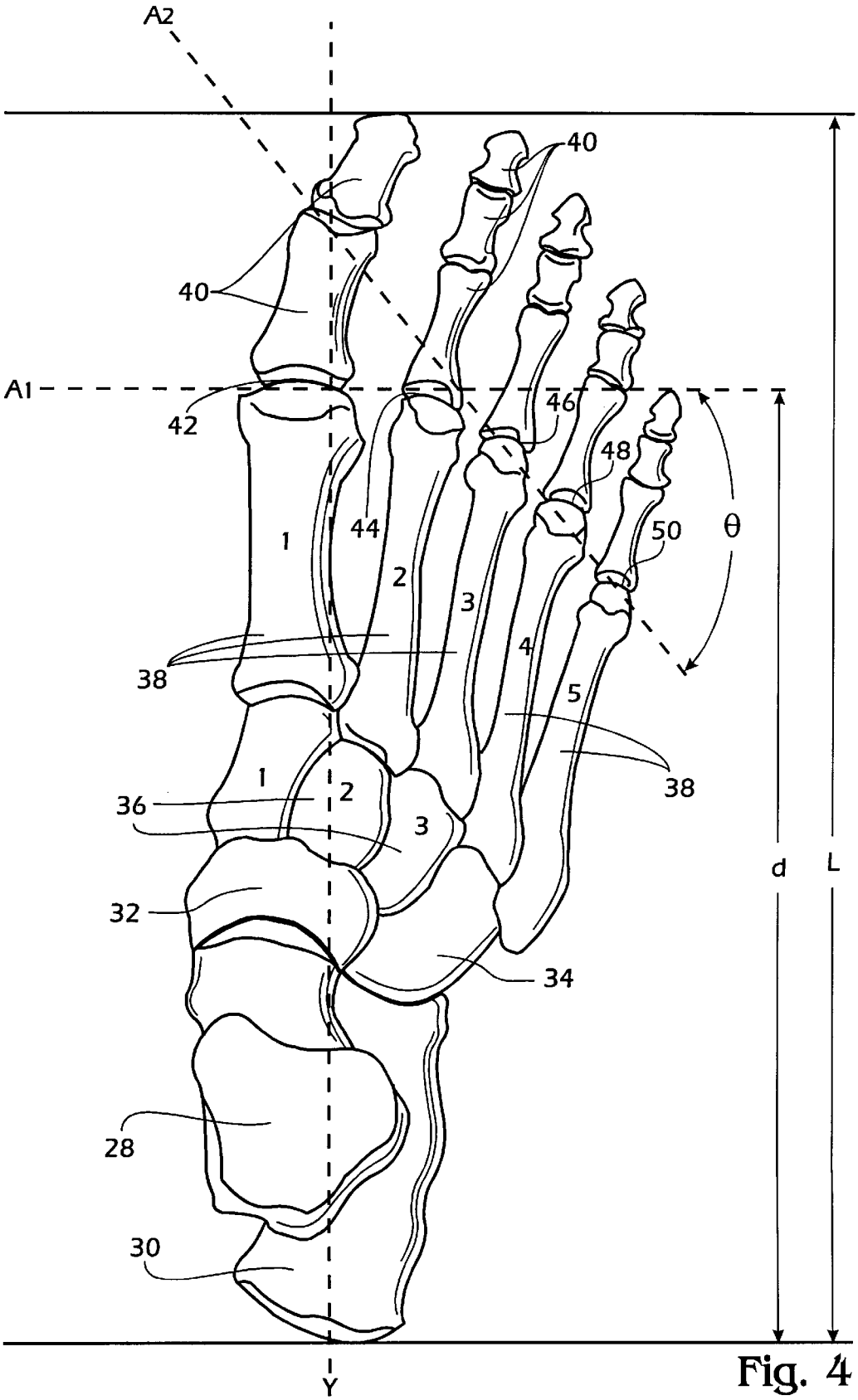
FIG. 4 is a top plan view of a human foot skeleton.

The embodiment shown in FIGS. 1–3 includes three distinct sole elements 18, 20 and 22, as shown mostly clearly in the bottom plan view of FIG. 3. The invention is not limited to a particular number or configuration of sole elements. As will be appreciated by persons skilled in the art, more or fewer sole elements of different configurations may be used. Sole elements may be positioned to correspond to one or more ground-engaging anatomical structures of the unshod foot. Referring to FIG. 4, these points include, but are not limited to, the calcaneus, the head of the first metatarsal, the head of the fifth metatarsal, the base of the fifth metatarsal, the head of the first distal phalange, and the head of the fifth distal phalange.

Figure 11:
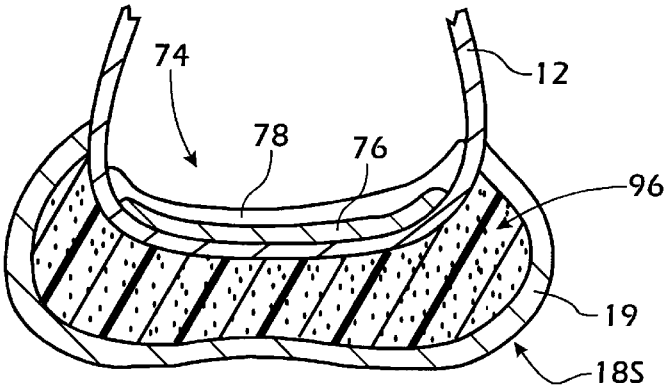
FIG. 11 is a cross sectional view of the shoe of FIG. 1 with the chassis of FIG. 9 taken along lines 11—11 in FIG. 3.

Each sole element provides traction, abrasion resistance and cushioning. These functions can be satisfied in many different ways. Referring to FIG. 11 for example, sole element 18 has a outer, abrasion-resistant layer made from a material such as a durable rubber. The outer layer 19 encases a cushioning material 96 such as EVA or PU. In the embodiment shown in FIGS. 1–3, sole elements 20 and 22 also include an outer abrasion-resistant layer encasing a cushioning material. Other embodiments of the sole elements are described further below. Each sole element is affixed to the bottom of the upper using conventional techniques such as gluing and/or stitching. Sole element 18 is affixed to the heel portion of the upper where it provides traction, and cushions impacts to the calcaneus or heel bone of the foot. Element 20 is affixed to the upper in the region underlying the "ball of the foot", and provides traction and cushioning for three critical load-bearing points on the foot: the first metatarsal head, the fifth metatarsal head, and the base of the fifth metatarsal in the lateral midtarsal portion of the foot. Sole element 22 is affixed to the upper below the toe region of the upper, and extends forward and upwardly around the front end of upper. Any number of different surface ornamentations can be applied to these portions, limited only by the creativity and ingenuity of the shoe designer.

Figure 12:
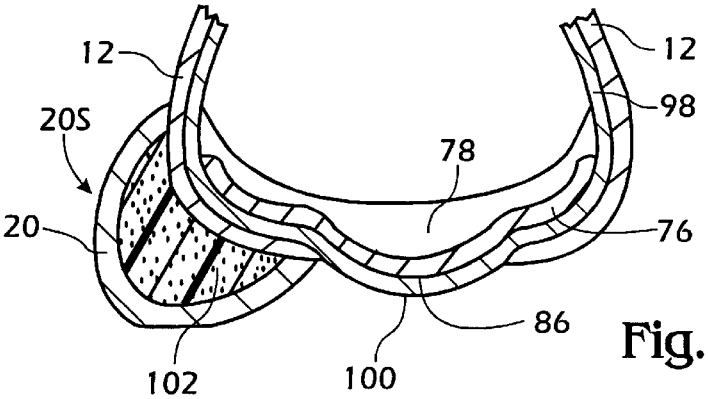
FIG. 12 is a cross sectional view of the shoe of FIG. 1 with the chassis of FIG. 9 taken along lines 12—12 in FIG. 3.

The sole elements 18, 20 and 22 in the preferred embodiment include rounded edges as shown at 18S in FIG. 11 and at 20S in FIG. 12, which extend upwardly around the medial and lateral sides of the sole, and follow the natural contour of the foot so as to provide maximum lateral stability. This is in contrast to the abrupt edges of the prior art, which can cause excessive ankle strain due to a lever arm effect, which is explained in greater detail in U.S. Pat. No. 5,317,819 to Ellis, the teachings of which are hereby incorporated by reference.

Figure 16:
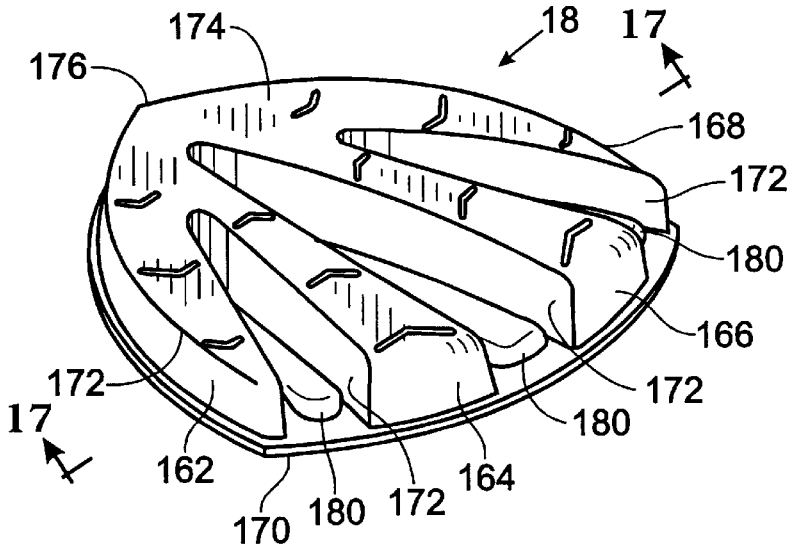
FIG. 16 is a perspective view of an embodiment of the sole elements of FIGS. 11 and 12.
Figure 17:
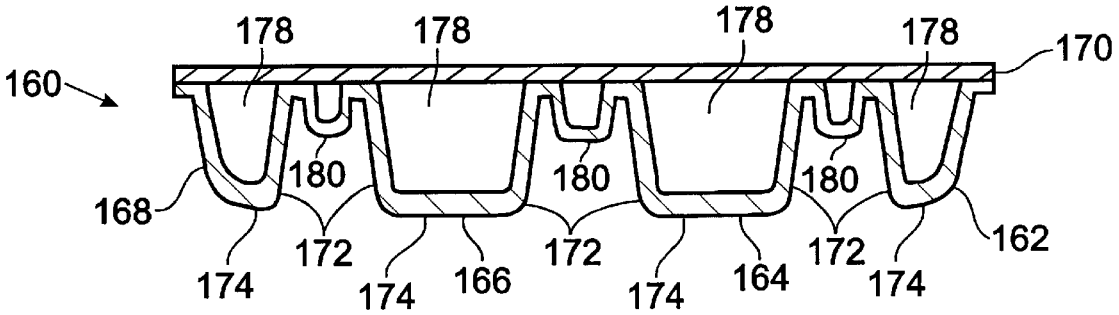
FIG. 17 is a cross sectional view of the sole element of FIG. 16.

In another embodiment, the sole elements are filled with gas, such as air, or a visco-elastic material. A yet further embodiment of the sole elements is shown in FIGS. 16 and 17. In those figures an individual sole element 160 is shown, which is preferably mounted on the shoe underneath the calcaneus bone, i.e., the heel. As in the embodiment described earlier, other similar sole elements can be placed in other load bearing points on the shoe corresponding to one or more ground-engaging anatomical structures of the unshod foot, including, but not limited to the calcaneus, the head of the first metatarsal, the head of the fifth metatarsal, the base of the fifth metatarsal, the head of the first distal phalange, and the head of the fifth distal phalange.

Sole element 160 includes a plurality of air or visco-elastic filled deformation elements 162, 164, 166 and 168. These deformation elements are mounted on a base layer 170. The deformation elements are preferably elongate, channels extending generally, radially outward from a common origin 176. The channels are formed by sidewalls 172 extending vertically upward from the base layer to a top, ground-contacting surface 174 and sealed by end-walls to form sealed interior channels 178. These channels 178 are then filled with a gas, such as air, or a visco-elastic material. A plurality of hollow, intermediate ribs 180 can be mounted on the base plate between adjacent deformation elements. The deformation elements allow the base plate to shift horizontally relative to the ground-contacting surface as a result of impact. This shifting reduces the impact by increasing the amount of time the load is dissipated over. Other embodiments of these deformation elements are described in commonly-assigned, copending patent application Ser. No. 08/327,461 filed Aug. 16, 1995 entitled "Anisotropic Deformation pad for Footwear," incorporated herein by reference. The shoe according to the invention can work with any of the embodiments shown therein.

As can be seen in FIG. 3, the sole is not a contiguous outsole, but instead has one or more gaps between the sole elements which expose the bottom side of the upper. In the preferred embodiment, two gaps are created by the design and placement of the sole elements, but the invention is not limited thereto. First medial gap 24 extends between the heel sole element and the forefoot sole element. This medial gap in general underlies the arch of the foot and extends across the entire width thereof. In the absence of any further structural support, the shoe is collapsible about this medial gap since the upper lacks much structural support. A second gap 26, referred to as a flex groove, is defined between the forefoot portion 20 and the toe portion 22. This X-shaped gap 26 exposes a similarly shaped portion of the upper about which the shoe flexes. Axes $F_1$, and $F_2$ correspond generally to the natural forward and lateral "push-off" flexure axes which are defined by the metatarsal phalangeal (MTP) joints, and which are described further below. In the preferred embodiment, axes $F_1$ and $F_2$ are set back about 10–15 mm from, and are parallel to, the respective forward and lateral push-off axes.

Structural support for the foot is provided by a structural chassis according to the invention. The design of the structural chassis is based on the structure and bio-mechanics of the human foot. A top plan view of a right human foot skeleton is shown in FIG. 4. The foot is attached to the leg (not shown) by the talus or anklebone 28. Positioned below and rearwardly of the talus 28 is the calcaneus 30 (i.e., the heel bone). The navicular 32 and the cuboid 34 are positioned below and forward of the talus 28. Three cuneiform bones 36 (labeled 1, 2 and 3) extend forwardly from the navicular 32. Extending forwardly from the cuneiform bones 36 and from the cuboid 34 are the five metatarsals 38, which are numbered 1 through 5 from left to right in FIG. 4 (i.e., from big toe to little toe). Forwardly of each metatarsal bone is a respective phalange 40 that forms the toe.

Between each metatarsal and its respective phalange is a metatarsal phalangeal (MTP) joint. Thus, there are five MTP joints in all: a first MTP joint 42, a second MTP joint 44, a third MTP joint 46, a fourth MTP joint 48, and a fifth MTP joint 50. These MTP joints can be used to define two axes about which the foot pushes off during certain push-off movements. A first axis $A_1$ is formed by a line generally through the first and second MTP joints 42 and 44, respectively. This first axis is used for push-off while running straight ahead and is thus referred to as the forward push-off axis. The forward push-off axis is located at approximately 69% of the distance L from heel to toe. The forward push-off axis is generally perpendicular to a longitudinal axis Y running through a midpoint of the talus 28 and the first MTP joint 42.

A lateral push-off axis $A_2$ is defined by a line running generally through the third (46), fourth (48), and fifth (50) MTP joints. The lateral push-off axis is used for push-offs towards the lateral side. The lateral push-off axis $A_2$ intersects the forward push-off axis $A_1$ at an acute angle Ø. The distance from the rear of the calcaneus bone to the intersection of lateral push-off axis intersects and the fifth MTP joint is approximately 62% of length L.

Figure 5:
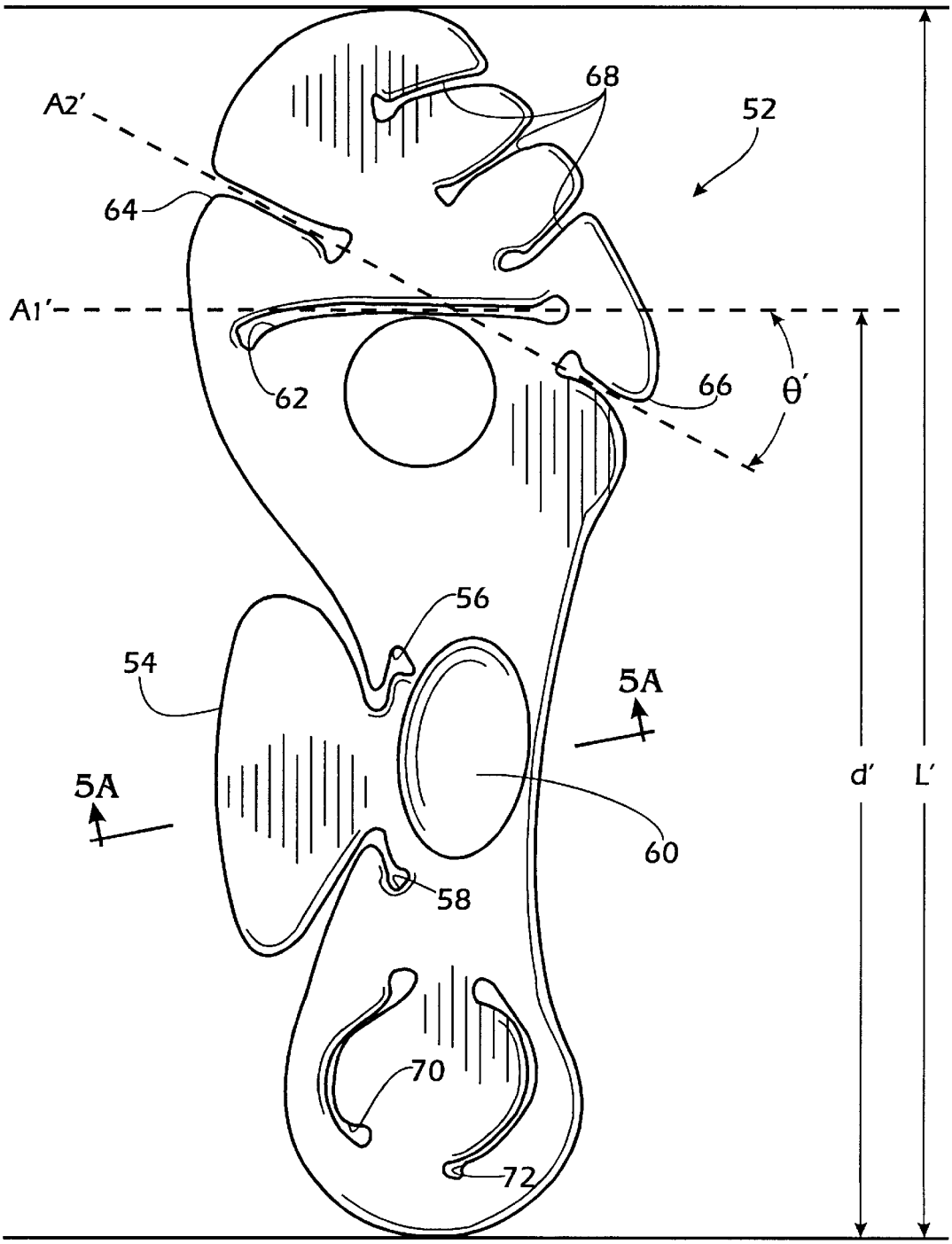
FIG. 5 is a top plan view of a first embodiment of a structural chassis for use with the shoe of FIG. 1.

Turning now to FIG. 5, structural chassis 52 is designed to accommodate the natural flexing of the foot about the above-defined push-off axes. In general, chassis 52 supports the foot along its entire length, and at the same time accommodates the foots natural flexion. Chassis 52 is generally shaped in plan view to match the outline of the foot, and extends the entire length thereof. Chassis 52 is preferably made of a relatively stiff, resilient material, such as vinyl or plastic, and provides the structural support for the shoe in those areas without any outsole or midsole material. The chassis can be custom-made to fit the user's foot as well as customized according to the requirements of the user's body and the shoe's intended application. The chassis 52 is inserted into the upper along with a foam insole or sock liner (not shown) which is interposed between the user's foot and the chassis. A combined chassis and foam insert assembly is shown and described hereinafter with reference to FIGS. 9 and 10.

The chassis 52 includes an arch support flange 54 that underlies the arch of the foot and provides structural support therefor. The size and shape of the flange 54 can be modified according to the amount of support required. Two notches 56 and 58 are cut into the chassis at the base of the flange to allow the chassis to twist about its longitudinal axis. The length and/or width of these notches 56 and 58 determines the torsional flexibility of the chassis about its longitudinal axis.

Adjacent the arch support flange 54 is a downwardly projecting protrusion 60 which serves to align and retain the chassis in place within the shoe. Since the chassis extends the full length of the footbed, however, the protrusion 60 is not essential to the operation of the chassis since the chassis will remain substantially in place in any case.

A transverse notch 62 is formed in the forefoot portion of the chassis and determines the flexibility of the chassis (and therefore the shoe) along axis $A_1'$. The notch 62 is formed along a forward axis $A_1'$ that is designed to generally underlie the forward push-off axis of the foot ($A_1$). Axis $A_1'$ is positioned approximately 10–15 mm forward of and parallel to axis $F_1$, when the chassis is inserted into the shoe. The length and width of notch 62 can be selected to provide a desired degree of stiffness and/or of flexibility along line $A_1$.

Notches 64 and 66 are formed on opposite sides of the chassis along axis $A_2$. Axis $A_2'$ underlays the lateral push-off axis ($A_2$) of the foot. Axis $A_2'$, as with axis as well $A_1'$, is positioned forward of (by approximately 10–15 mm) and parallel to axis $F_2$ of the flex groove portion 26. This separation ensures that the ground-engaging portion of the sole element remains in contact with the ground as the shoe flexes. As with notch 62, the length and/or width of these two notches can be adapted individually to produce the desired stiffness and/or flexibility of the shoe about the lateral axis $A_2'$. The forward and lateral axes $A_1'$ and $A_2'$ intersect one another at an angle Ø, which corresponds generally to the angle of intersection of the forward and lateral push-off axes of the foot shown and described above. In the preferred embodiment of the invention, the angle Ø and Ø' are 37 degrees, although other angles could be selected.

Chassis 52 may further include three notches 68 in the toe portion that permit the shoe to flex in that area. Each notch 68 begins at a point on the outer perimeter of the chassis between two adjacent toes allowing the chassis to flex individually in between the toes. The length and/or width of these notches can be adjusted to adapt the flexibility of the chassis (and therefore, the shoe) about the toe portion according to the requirements of the user.

Two arcuate slots 70 and 72 are formed in the heel portion of the chassis to provide flexibility in this region. Additional slots can be formed within these two slots 70 and 72 if additional flexibility is required in this region and, as with the other notches described above, the length and/or width can be modified.

Figures 6, 7, 8:
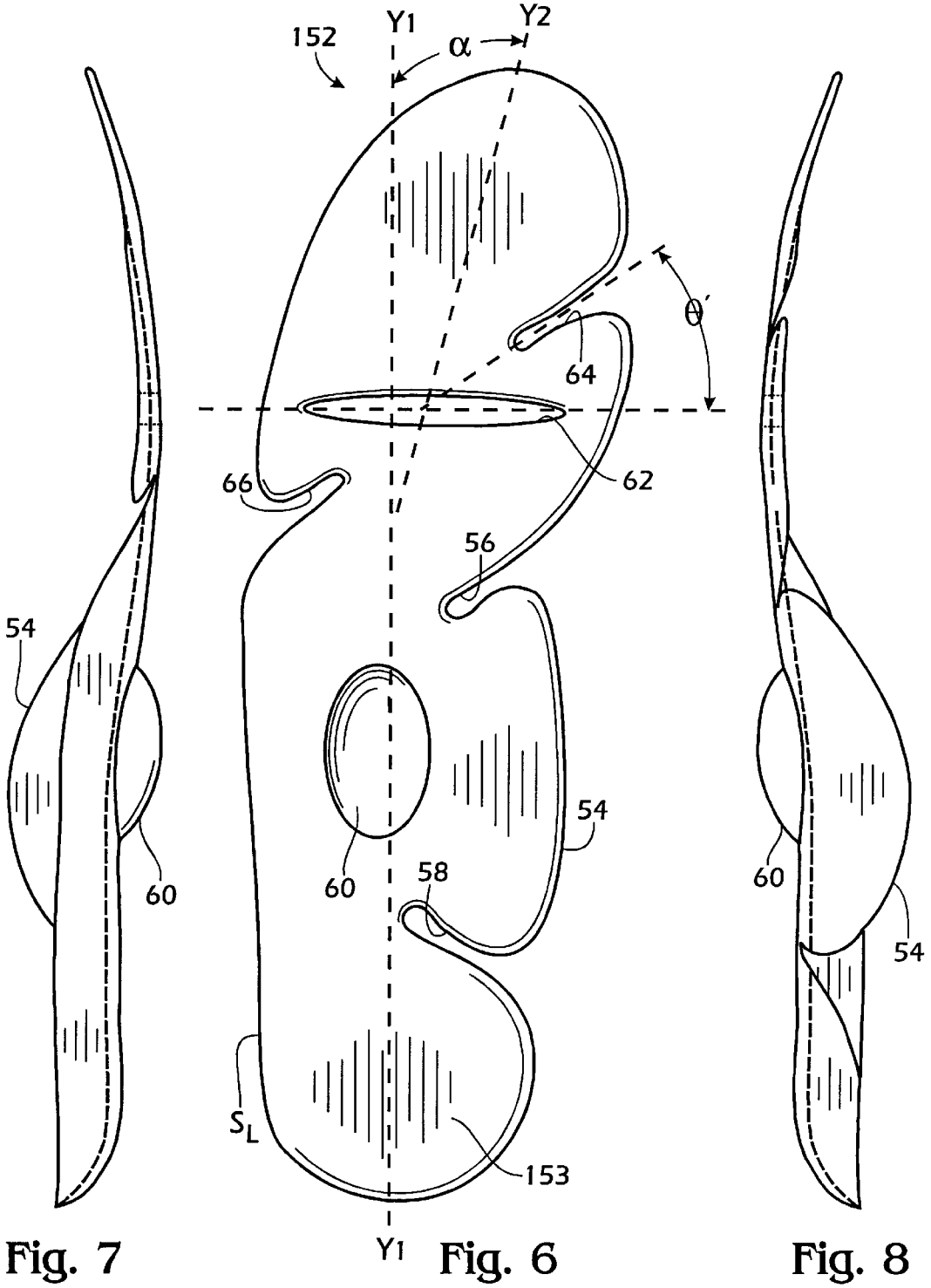
FIG. 6 is a top plan view of a second embodiment of a structural chassis for use with a left shoe according to the invention.
FIG. 7 is an elevational view of the lateral side of the structural chassis of FIG. 6.
FIG. 8 is an elevational view of the medial side of the structural chassis of FIG. 6.

A second embodiment of a structural chassis for a left foot is shown in FIGS. 6–8. The chassis 152 shown therein is similar to that shown in FIG. 5, and common elements retain common reference numerals. There are, however, several differences between the two chassis. The first is that the lateral edge portion $S_L$ along the lateral side of the chassis 152 is straight. Another is that a toe portion of chassis 152 is offset by an angle relative to a longitudinal axis Y1 bisecting the midfoot and heel portions of the chassis. This angle is approximately 10–20 degrees in the preferred embodiment. Yet another difference is that the axis running through the slot 62 is approximately perpendicular to the longitudinal axis $Y_1$. The angle Ø, however, remains the same as in chassis 52. The arch support flange 54 and heel portion 153 of the chassis 152 are also reinforced to provide additional structural support relative to the rest of the chassis. In the preferred embodiment of this chassis, arch support flange 54 and heel portion 153 have a thickness of approximately 3 mm while the remainder of the chassis is approximately 2.5 mm.

Figure 9:
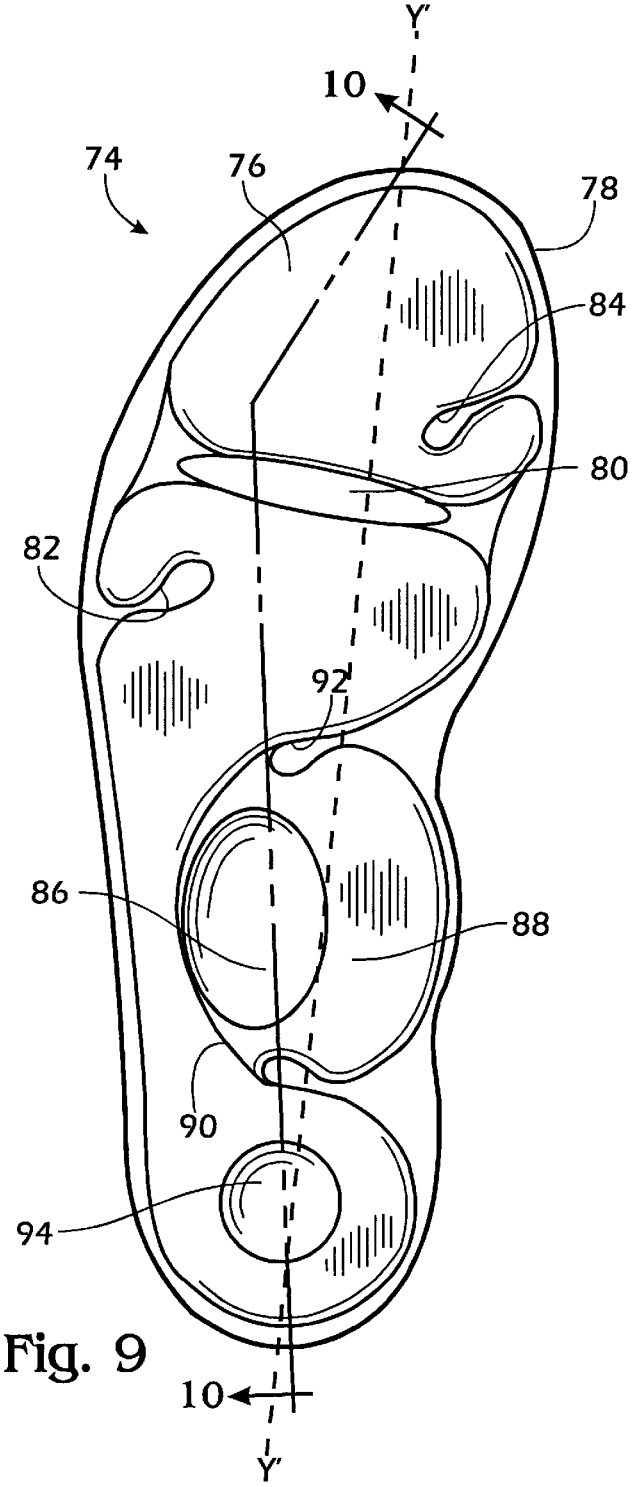
FIG. 9 is a bottom plan view of a structural chassis comprised of a third embodiment of a structural chassis and a foam chassis for use with the shoe of FIG. 1.

Referring now to FIG. 9, a bottom plan view of a third embodiment of the invention, shown at 74, comprises a chassis 76 integrally bonded to a foam insert or sock liner 78. The sock liner 78 forms the outer perimeter of the chassis since the chassis 76 has a slightly smaller footprint. Thus a small space exists between the sock liner 78 and the chassis 76 around the perimeter of insert 74, as shown in FIG. 9.

Chassis 76 includes a slot 80 which is offset relative to the forward push axis of the foot (not shown) by an acute angle. Opposing tear-shaped notches 82 and 84 are also included on chassis 76, to allow the chassis to flex about a lateral axis formed therethrough. Chassis 152 further includes a protrusion or bubble 86 that aligns the chassis in the upper, as well as an arch support flange 88 extending upwardly away therefrom. Opposed notches 90 and 92 adjacent flange 88 provide flexibility about longitudinal axis Y'. A slight depression 94 forms a downwardly deflectable portion in the heel portion of chassis 152.

Figure 10:
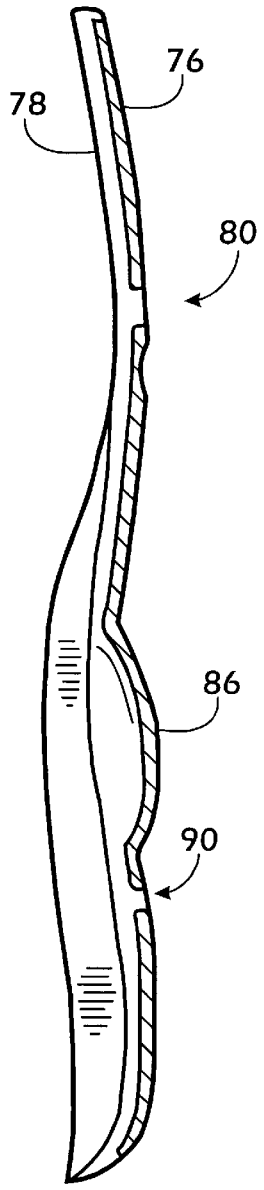
FIG. 10 is a cross sectional view of the structural chassis of FIG. 9 taken about lines 10—10 therein.

FIG. 10, a cross sectional view of chassis 152 taken about line 10—10 in FIG. 9, shows that the chassis and the foam inlay or sock liner are contoured to the underside of the foot. The exception to this is the protrusion 86 on the chassis that extends downwardly away from the foam inlay and which is occupied thereby. As will be described further below, this protrusion or bubble 86 fits within a hole formed in the bottom side of the upper to align the chassis within the footbed of the shoe and keep the chassis from slipping. The bubble, however, is not essential to the main object of the invention.

Two cross sectional views of the assembled shoe shown in FIGS. 1–3 are shown in FIGS. 11–12. The cross sectional view shown in FIG. 11 is taken about lines 11—11 in FIG. 3 while that shown in FIG. 12 is taken about lines 12—12 therein. Referring now to FIG. 11, chassis 76 is shown in the footbed of upper 12, and overlaid by the foam insole or sock liner 78 is placed in direct contact with the foot while the structural chassis 76 is interposed between the foam inlay or sock liner 78 and the upper 12. Affixed to the bottom side of the upper is the heel sole element 18 is filled with a cushioning midsole material 96 such as ethyl vinyl acetate (EVA).

Figure 13A:
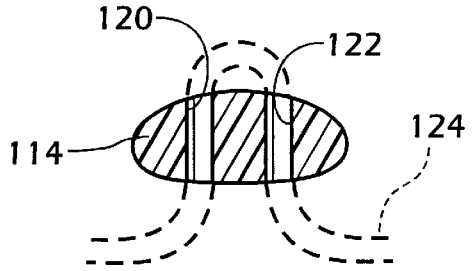
FIG. 13A is a cross sectional view of the lace guide of FIG. 13 taken about lines A—A therein.
Figure 13B:
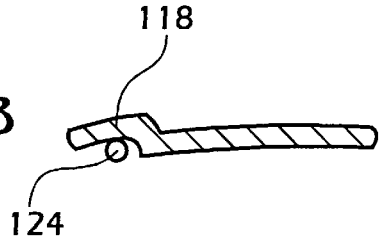
FIG. 13B is a cross sectional view of the lace guide of FIG. 13 taken about lines B—B therein.
Figure 13C:
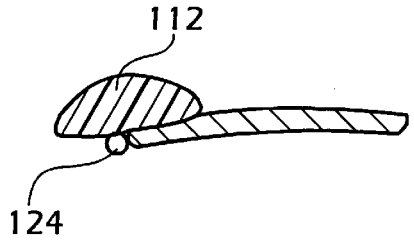
FIG. 13C is a cross sectional view of the lace guide of FIG. 13 taken about lines C—C therein.
Figure 13D:
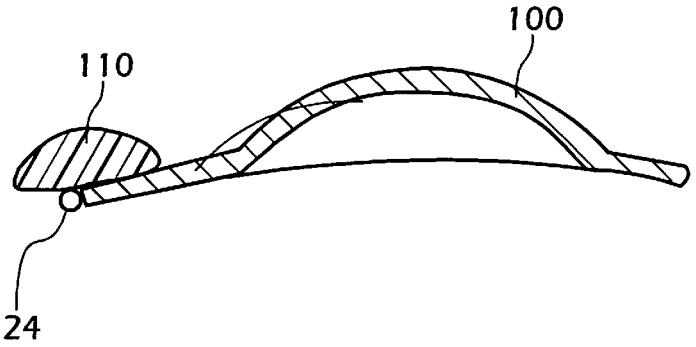
FIG. 13D is a cross sectional view of the lace guide of FIG. 13 taken about lines D—D therein.
Figure 5A:
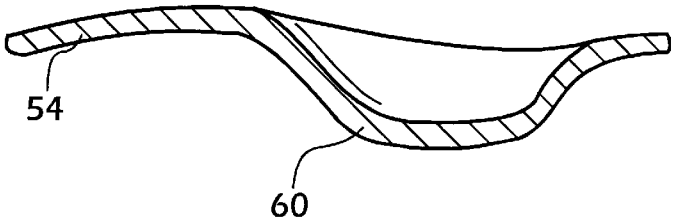
FIG. 5A is a cross sectional view of the structural chassis of FIG. 5 taken along lines A—A.
Figure 13:
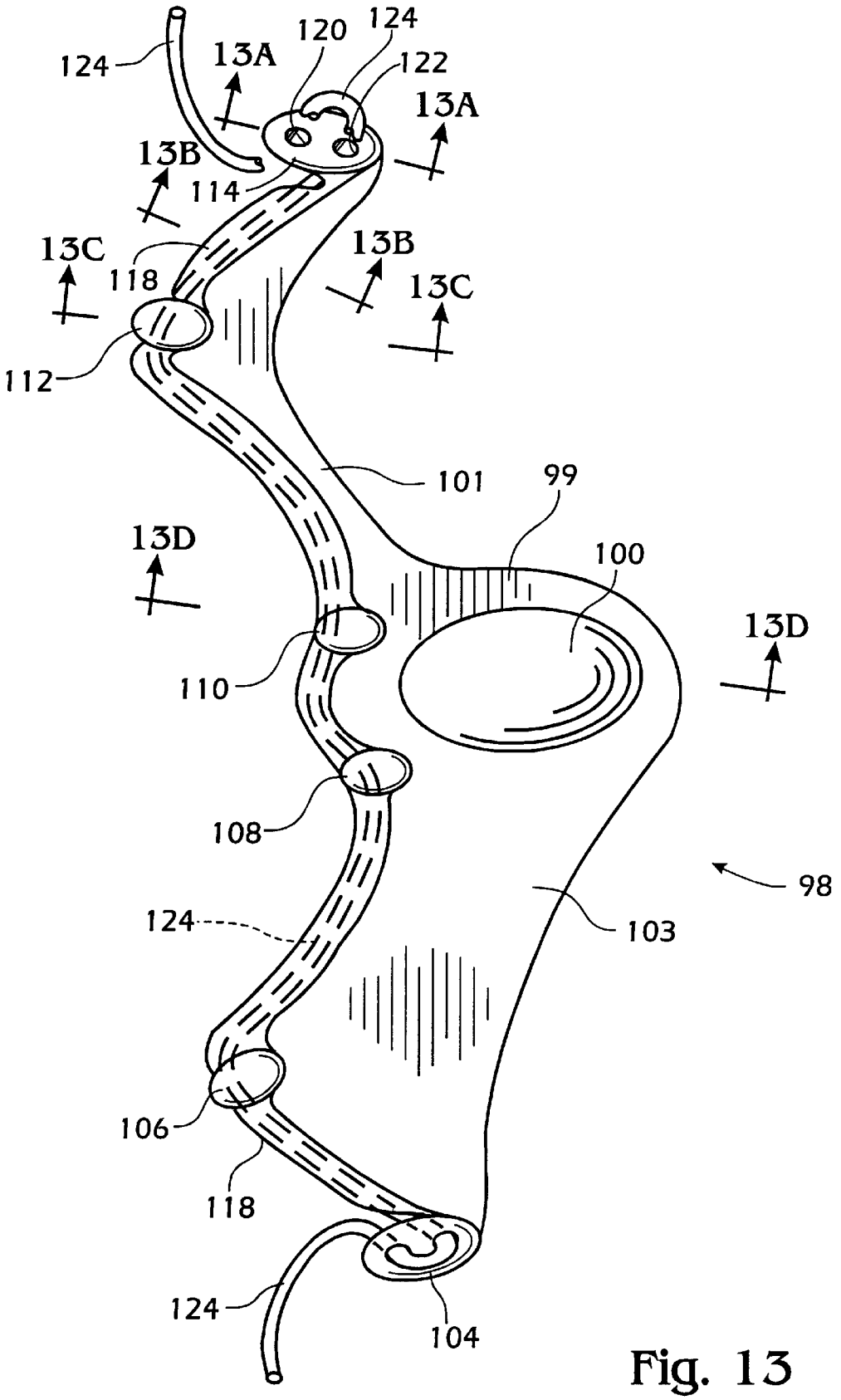
FIG. 13 is a bottom plan view of a first embodiment of a lace guide of the shoe shown in FIG. 1 according to another aspect of the invention.

Referring now to FIGS. 3 and 12–13, a lace guide 98 is generally shown. Lace guide 98 is a flexible plastic piece that is sewn into the upper through which a shoe lace is guided to secure the shoe to the foot. The lace guide includes a bubble 100 that forms a receptacle that receives the protrusion 86 of the structural chassis. In the preferred embodiment, the outer surface of protrusion 86 is placed in an abutting relationship with an inner surface of the bubble 100. Although the bubble 100 shown and described herein is oval in shape, it is not limited thereto. Rather, any shape that acts to align the structural chassis in the footbed can be used so long as it is shaped to be received therein. In addition, also affixed to the bottom side of the upper is sole element 20 which is filled with a cushioning material 102, such as EVA or PU.

A plan view of lace guide 98 is shown in FIG. 13. Lace guide 98 wraps around the underside of the shoe and extends up along both sides. Bubble 100 is received in an opening 116 in upper 12 (FIG. 3) to align the lace guide with the upper. In one embodiment, lace guide 98 is made of a translucent material so that the chassis is visible through the bubble on the underside of the shoe. The lace guide is made of a flexible, lightweight material so that the lace guide does not significantly contribute to the weight of the shoe nor inhibit the flexibility of the shoe. The lace guide is not essential to the main object of the invention and therefore could be replaced by a conventional shoelace system along the tongue of the shoe. In that case, a separate bubble or receptacle could be mounted on the opening 116 in the upper to provide a receptacle for the chassis protrusion. Alternatively, the receptacle could be completely eliminated since the structural chassis will be effectively aligned in the upper by virtue of the fact that it occupies essentially the entire footbed.

Lace guide 98 includes a base portion 99 that is sewn into the bottom side of the upper and two opposing arms 101 and 103. The arms extend upwardly along opposite sides of upper 12, and are sewn thereto. In one embodiment arm 101 is thinner than arm 103, and extends along the inner or medial side of the upper, i.e., the side of the shoe having the arch, while arm 103 extends up along an outer or lateral side thereof. Lace guide 98 includes a plurality of beads 104, 106, 108, 110, 112 and 114 mounted along one side thereof. Extending between each adjacent bead is a lip such as lip 118 (FIG. 13B) between beads 112 and 114 behind which the lace runs. The orientation of the lower three beads is the same as the upper three beads, which is shown in cross sectional views FIG. 13A, FIG. 13C and FIG. 13D. For example, bead 110 points inwardly (FIG. 13D), i.e., toward the toe, while bead 112 points outwardly (FIG. 13C), opposite the direction of bead 110, so that a lace 124 wraps around opposite sides of beads 110 and 112. The distal beads 114 and 104 each include two holes such as holes 120 and 122 for bead 114. The lace 124 threads through these two holes and out one side of the bead. The lace can then be tightened by pulling the lace through these two holes (and around the other beads), but the holes prevent the lace from slipping back out after the tightening force has been removed. Thus, the holes allow the lace to be first cinched and then tied without having to apply constant force to the lace to keep the lace tightened. Alternatively, a single hole can be used, in place of the two holes, so that the lace does not have to return through the second hole.

Figure 14:
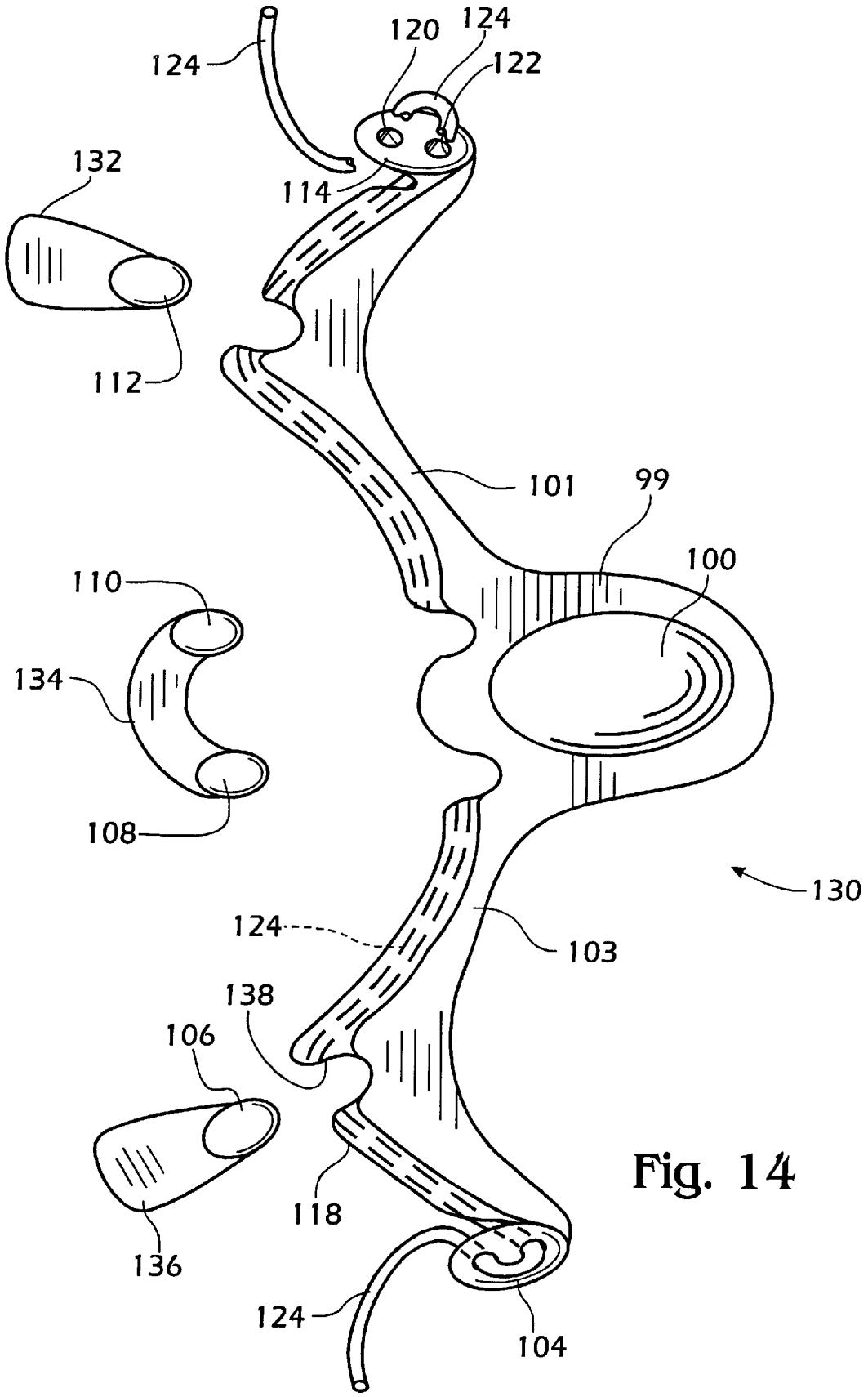
FIG. 14 is a bottom plan view of a second embodiment of a lace guide of the shoe shown in FIG. 1.

A second embodiment of the lace guide 130 is shown in FIG. 14. In this embodiment, the beads 106, 108, 110 and 112 are formed separately from the main body of the guide including bubble 100 and arms 101 and 103. Bead 106 is mounted on piece 136, beads 108 and 110 on C-shaped piece 134, and bead 112 on piece 132. Each piece is sewn into the shoe upper opposite a respective notch in the lace guide (e.g., notch 138) that receives the bead. The lace is then laced around the beads as described above. This design address a potential problem with the lace guide of FIG. 13 caused by the pressure applied by the lace to the arms 101 and 103 of the guide when the lace is cinched up. This pressure can cause the lace to work its way under the lips of the guide. By mounting the beads on separate pieces the pressure is exerted against these separate pieces rather than the remaining body of the lace guide. Those separate pieces (i.e., 132–136) can then be more securely fastened than the guide body.

The advantage of the lacing system shown and described herein is that the lace does not pass over and irritate and restrict connective tissue as can occur with the conventional lacing system.

Figure 15:
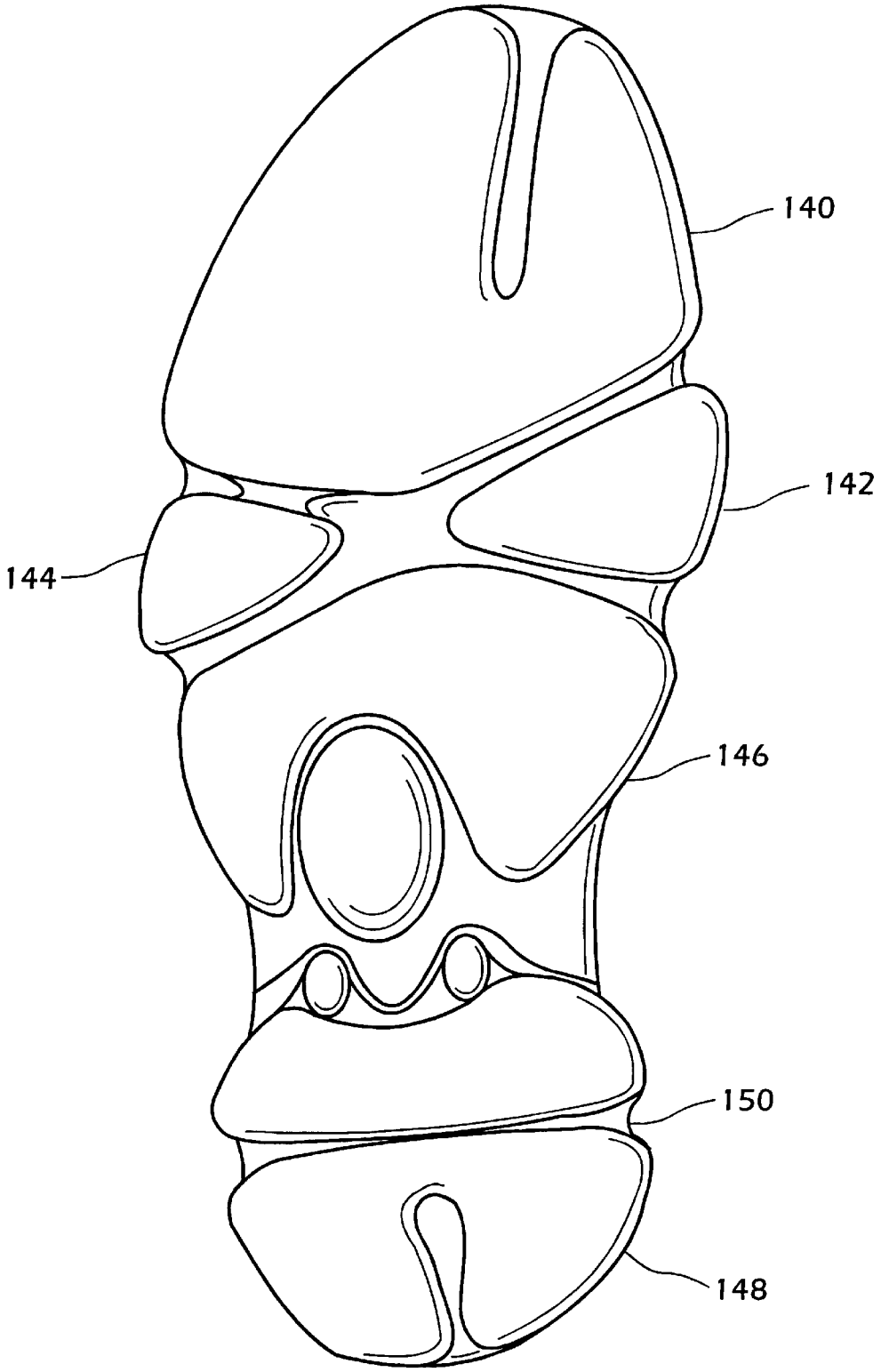
FIG. 15 is a bottom plan view of a second embodiment of a shoe according to the invention.

Having described and illustrated the principles of the invention in a preferred embodiment thereof, it should be apparent that the invention can be modified in arrangement and detail without departing from such principles. For example, the design of the sole elements can be modified so that different portions of the upper are exposed than those shown above. An example of such an alternative design is shown in FIG. 15. In that design the sole elements include a toe element 140, a forefoot element 146, and a heel element 148. Two additional forefoot elements 142 and 144 are disposed between the toe portion and the forefoot portion. The lateral element 144 is integrally formed with the main forefoot portion 146 while the medial forefoot element 142 is a separately formed element. These elements are arranged so as to create a flex-groove therebetween as described further above. The heel portion 148 also includes a heel flex groove 150. Unlike the forefoot flex groove, however, the heel flex groove 150 does not necessarily expose the upper. Instead the sole element is grooved in this area so as to provide a desired amount of stiffness and/or flexibility in heel area.

In a related embodiment, the chassis is attached to the external bottom surface of the upper, and the sole elements are attached directly to the chassis. Another modification coming within the scope of the applicants' invention is the use of a "flex zone" made in the structural chassis as compared with discrete notches or cuts therein. These "flex zones" can be made by varying the thickness or composition of the material used in the structural chassis to achieve the desired level of flexibility and/or stiffness. We claim all modifications and variation coming within the spirit and scope of the following claims.

We claim:

1. A shoe comprising:

an upper including a bottom surface having a first exposed portion;

at least one sole element affixed to the bottom surface of the upper; and a removable chassis in the upper, the chassis including a foot-supporting surface having a portion disposed above the first exposed portion of the bottom surface of the upper, wherein the bottom surface of the upper includes a first opening, and wherein the chassis includes a protruding portion engaged with the first opening.

2. A shoe according to claim 1 wherein a portion of the chassis above the first opening is visible through the first opening.

3. A shoe according to claim 1 which further includes a protective cover engaged with the first opening.

4. A shoe according to claim 2 wherein the chassis heel-supporting portion includes a downwardly deflectable portion.

5. A shoe according to claim 4 wherein the downwardly deflectable portion includes surfaces defining at least one slot.

6. A shoe according to claim 1 wherein the foot-supporting surface of the chassis is formed from a cushioning material.

7. A shoe according to claim 6 wherein the chassis comprises a first member and a cushioning material attached thereto.

8. A shoe according to claim 7 wherein the chassis is formed by a method comprising the steps of:

forming the first member;

providing a mold;

placing the first member into the mold;

introducing a cushioning material into the mold;

attaching the cushioning material to the first member; and removing the chassis from the mold.

9. A shoe according to claim 1 wherein the at least one sole element includes:

a heel sole element;

a forefoot sole element spaced apart from the heel portion; and the exposed portion of the bottom surface of the upper being between the forefoot and heel sole elements.

10. A shoe according to claim 9 wherein the at least one sole element further comprises a toe sole element spaced apart from the forefoot sole element, the bottom surface of the upper having a flexible portion between the toe and forefoot sole elements.

11. A shoe according to claim 10 wherein the chassis includes surfaces defining a first flexion axis corresponding to the flexible portion of the upper between the forefoot and toe sole elements.

12. A shoe according to claim 11 wherein the first flexion axis corresponds to a first push-off axis of a wearer's foot.

13. A shoe according to claim 12 wherein the first push-off axis is defined by a line passing through the first and a second metatarsal phalangeal joints of the wearer's foot.

14. A shoe according to claim 12 wherein the first flexion axis is aligned with a second push-off axis of the foot running generally through a third, fourth and fifth metatarsal phalangeal joints of the foot.

15. A shoe according to claim 12 wherein the chassis further includes surfaces defining a second flexion axis corresponding to the flexible portion of the upper between the forefoot and toe sole elements.

16. A shoe according to claim 15 wherein the second push-off axis of the foot is defined by a line passing generally through a third, fourth and fifth metatarsal phalangeal joints of the foot.

17. A shoe according to claim 15 wherein the surfaces defining a second flexion axis define a pair of opposed slots.

18. A shoe according to claim 16 wherein the chassis further comprises an arch-supporting portion.

19. A shoe according to claim 1 wherein the foot supporting surface of the chassis further includes:

a heel supporting portion; and a forefoot supporting portion.

20. A method of forming a shoe comprising:

forming a flexible, non-supportive upper having an interior portion and a bottom surface;

attaching a plurality of sole elements to the bottom surface of the upper, leaving at least one portion of the bottom surface of the upper exposed;

forming a structural chassis adapted to support the foot, including at least one portion of the foot corresponding to the at least one exposed portion of the bottom surface of the upper; and inserting the structural chassis into the interior portion of the upper, the bottom surface of the upper including a first opening, and the chassis having a protruding portion engaged with the first opening.

21. The method of claim 20 wherein the structural chassis includes surfaces defining a first flexion axis corresponding to a forward push-off axis of a wearer's foot as defined by a line passing through first and second metatarsal phalangeal joints of the foot.

22. The method of claim 20 wherein the structural chassis includes surfaces defining a second flexion axis corresponding to a lateral push-axis of the wearer's foot as defined by a line passing through third, fourth and fifth metatarsal phalangeal joints of the foot.

23. The method of claim 21 wherein the surfaces defining a first flexion axis define a transverse slot in the chassis.

24. The method of claim 22 wherein the surfaces defining a second flexion axis define a pair of opposed notches in the chassis.

25. The method of claim 20 wherein the at least one sole element includes a toe sole element and a forefoot sole element, and wherein the exposed portion of the bottom surface of the upper includes an elongate, transverse gap between toe and forefoot sole elements, and an intersecting, elongate, oblique gap between toe and forefoot sole elements.

26. The method of claim 25 wherein the transverse gap corresponds to a first, push off axis running through first and a second metatarsal phalangeal joints of a wearer's foot, and wherein the oblique gap corresponds to a second push off axis running through third, fourth, and fifth metatarsal phalangeal joints of a wearer's foot.

27. The method of claim 20 wherein the at least one sole element includes a heel sole element and a forefoot sole element, and wherein the at least one exposed portion of the bottom surface of the upper includes an exposed portion therebetween.

28. A shoe comprising:

an upper having a bottom wall;

a plurality of spaced-apart sole elements affixed to the bottom wall outer surface;

the bottom wall having at least one unsupported portion between the sole elements; and a structural chassis within the upper and having a foot-supporting surface above the at least one unsupported portion of the bottom of the upper, the bottom surface of the upper including a first opening, and the chassis having a protruding portion engaged with the first opening.

29. A shoe according to claim 28 wherein the structural chassis is removable.

30. A shoe according to claim 28 wherein the bottom wall is a flexible, non-supportive wall.

31. A shoe according to claim 28 wherein the at least one sole element is affixed to the bottom wall at a location selected to underlie a portion of the wearer's foot selected from the group consisting of the calcaneus, the head of the first metatarsal, the head of the fifth metatarsal, the base of the fifth metatarsal, the head of the first distal phalange, and the head of the fifth distal phalange.

32. A shoe according to claim 28 wherein the unsupported portion of the bottom wall is positioned to underlie a portion of a wearer's arch.

33. A shoe according to claim 28 wherein the at least one unsupported portion of the bottom wall includes a portion positioned to underlie a push-off axis defined by a line passing through the first and second metatarsal-phalangeal joints of a wearer's foot.

34. A shoe according to claim 28 wherein the unsupported portion of the bottom wall is positioned to underlie a push-off axis defined by a line passing through the third, fourth and fifth metatarsal-phalangeal joints of a wearer's foot.

35. A shoe according to claim 28 wherein the at least one unsupported portion of the bottom wall includes a portion adapted to underlie the arch of a wearer.

* * * * *